US010891924B2

(12) United States Patent
Lu

(10) Patent No.: US 10,891,924 B2
(45) Date of Patent: Jan. 12, 2021

(54) MUSICAL INSTRUMENT SOUND AMPLIFYING DEVICE

(71) Applicant: Yun-Hsin Lu, Kaohsiung (TW)

(72) Inventor: Yun-Hsin Lu, Kaohsiung (TW)

( * ) Notice: Subject to any disclaimer, the term of this patent is extended or adjusted under 35 U.S.C. 154(b) by 0 days.

(21) Appl. No.: 16/899,607

(22) Filed: Jun. 12, 2020

(65) Prior Publication Data

US 2020/0394986 A1 Dec. 17, 2020

(30) Foreign Application Priority Data

Jun. 14, 2019 (CN) ..... 2019 1 0513940

(51) Int. Cl.
*G10D 13/02* (2020.01)
*G10D 3/02* (2006.01)
*G10D 3/01* (2020.01)

(52) U.S. Cl.
CPC ..... *G10D 3/02* (2013.01); *G10D 3/01* (2020.02)

(58) Field of Classification Search
CPC ..... G10D 3/02; G10D 3/01
See application file for complete search history.

(56) References Cited

U.S. PATENT DOCUMENTS

2008/0156167 A1* 7/2008 Langberg ..... G10H 3/00 84/267
2019/0261087 A1* 8/2019 Petracek ..... H04R 1/2811

* cited by examiner

*Primary Examiner* — Kimberly R Lockett

(57) ABSTRACT

A musical instrument sound amplifying device includes a hollow annular chamber formed inside the musical instrument sound amplifying device; a flaring slot including a lug on a bottom; and a bowl-like annular base including a dimple part on a bottom. The lug is secured to the dimple part. An annular sound hole is disposed between an opening of the bowl-like annular base and an edge of the flaring slot. An inner circumference of the bowl-like annular base is a 3D ring structure of concave surface.

4 Claims, 11 Drawing Sheets

MUSICAL INSTRUMENT SOUND AMPLIFYING DEVICE

BACKGROUND OF INVENTION

1. Field of the Invention

The invention relates generally to musical instrument, and more particularly to a musical instrument sound amplifying device for increasing the loudness of musical instrument sound and generating a 3D surround sound field when playing violoncello.

2. Description of Related Art

The inside of the sound amplification box of the general violoncello is actually a hollow structure, and the acoustic vibration effect generated by the violoncello is reflected only by the grid panels around the box to increase the loudness of musical instrument sound. However, the effect of the reflective amplification of musical instrument sound by the plane structure of grid panels on increasing the loudness of musical instrument sound is limited. Moreover, a few sound holes are made around the known sound amplification box, so the musical instrument sound emitted from the box has specific directionality, there is no 3D surround sound field effect.

Thus, the need for improvement still exists.

SUMMARY OF THE INVENTION

It is therefore one object of the invention to provide a musical instrument sound amplifying device comprising a flaring slot and a bowl-like annular base; the bottom surface of the flaring slot is provided with a lug; the bottom of the bowl-like annular base is provided with a dimple part; the lug on the bottom surface of the flaring slot is fixed to the dimple part in the bottom of the bowl-like annular base, and a hollow annular chamber is formed inside the musical instrument sound amplifying device; wherein there is an annular sound hole between the opening of the bowl-like annular base and the edge of the flaring slot; the inner circumference of the bowl-like annular base is a 3D ring structure of concave surface.

The above and other objects, features and advantages of the invention will become apparent from the following detailed description taken with the accompanying drawings.

DETAILED DESCRIPTION OF THE INVENTION

Figure 1:
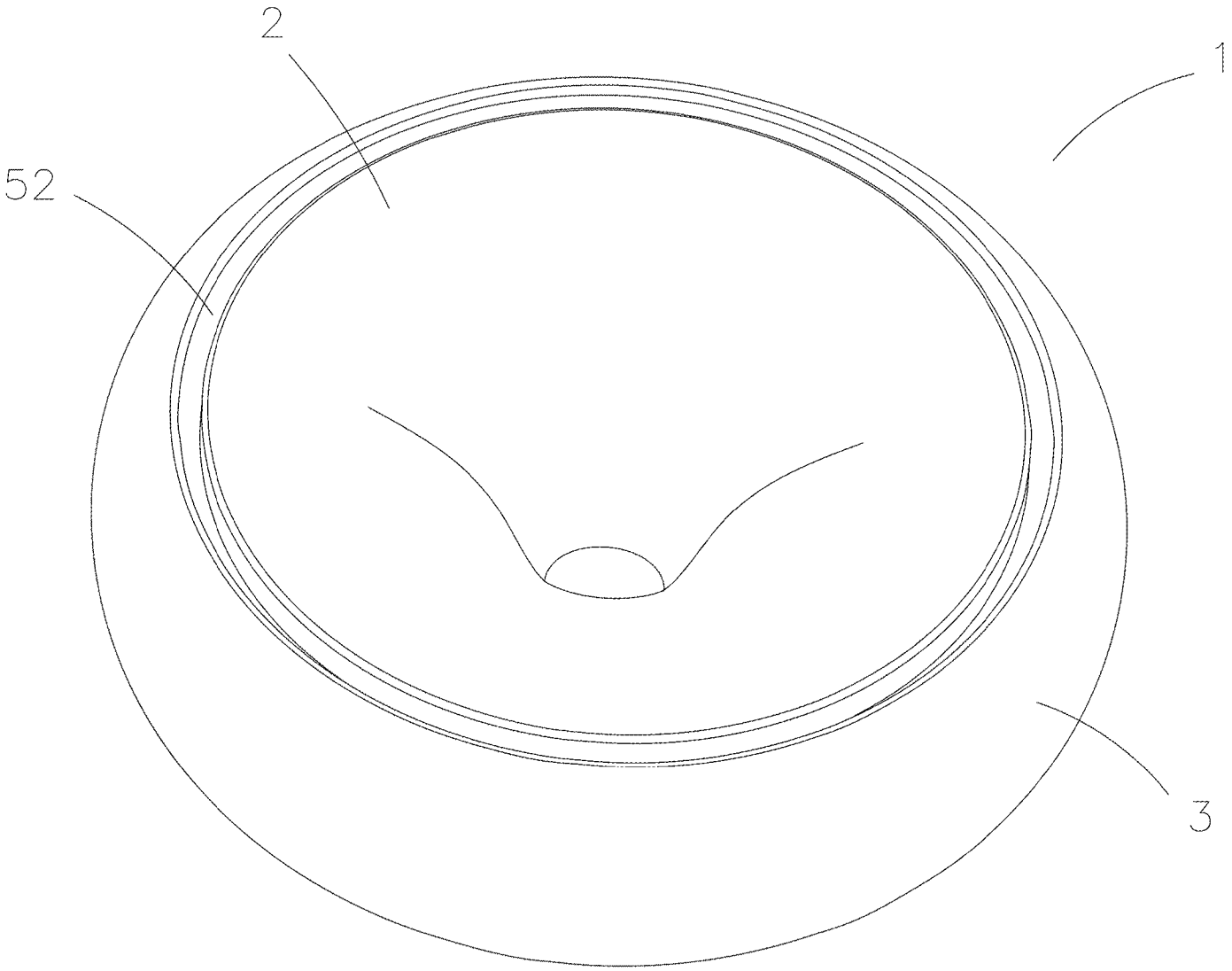
FIG. 1 is a perspective view of a first preferred embodiment of the invention.
Figure 2:
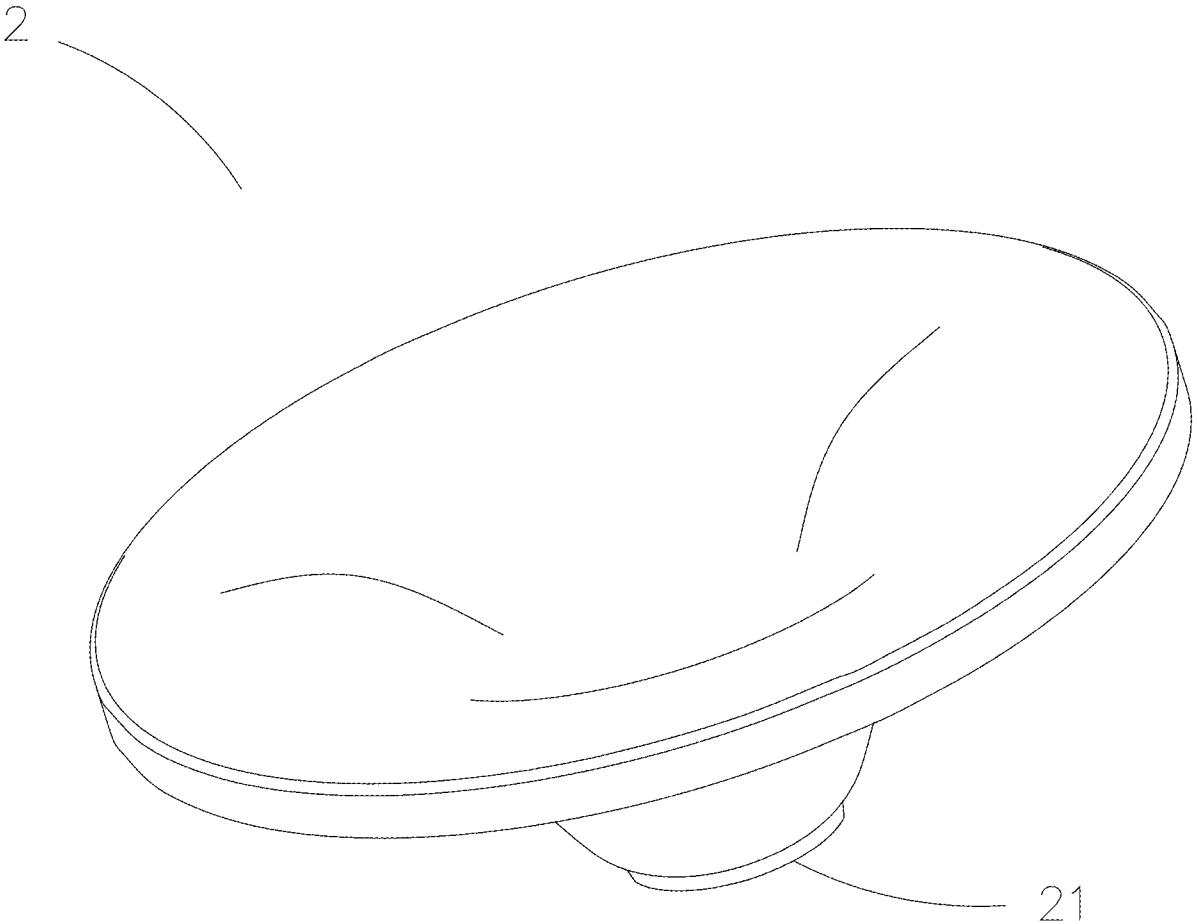
FIG. 2 is a perspective view of flaring slot.
Figure 3:
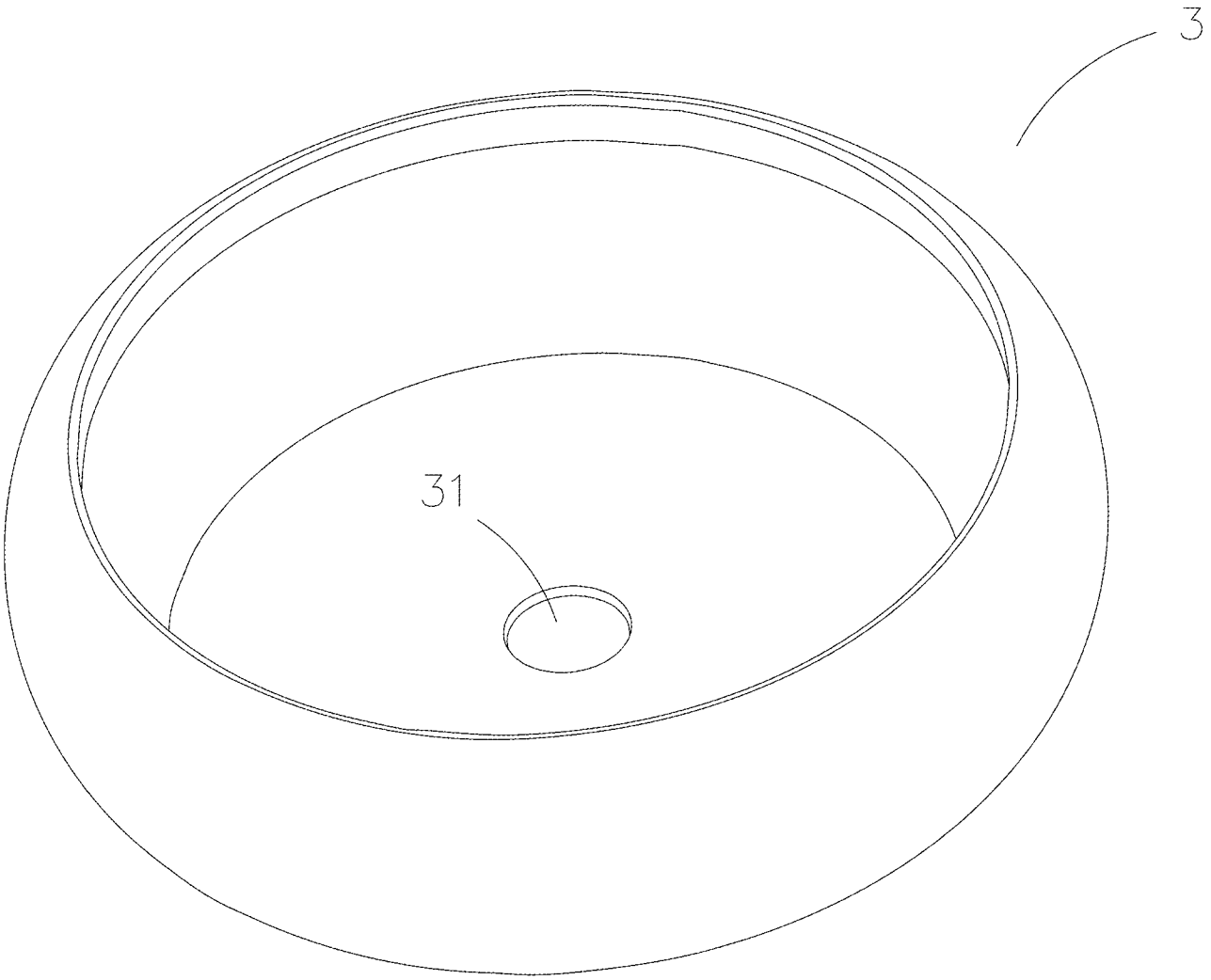
FIG. 3 is a perspective view of bowl-like annular base.
Figure 4:
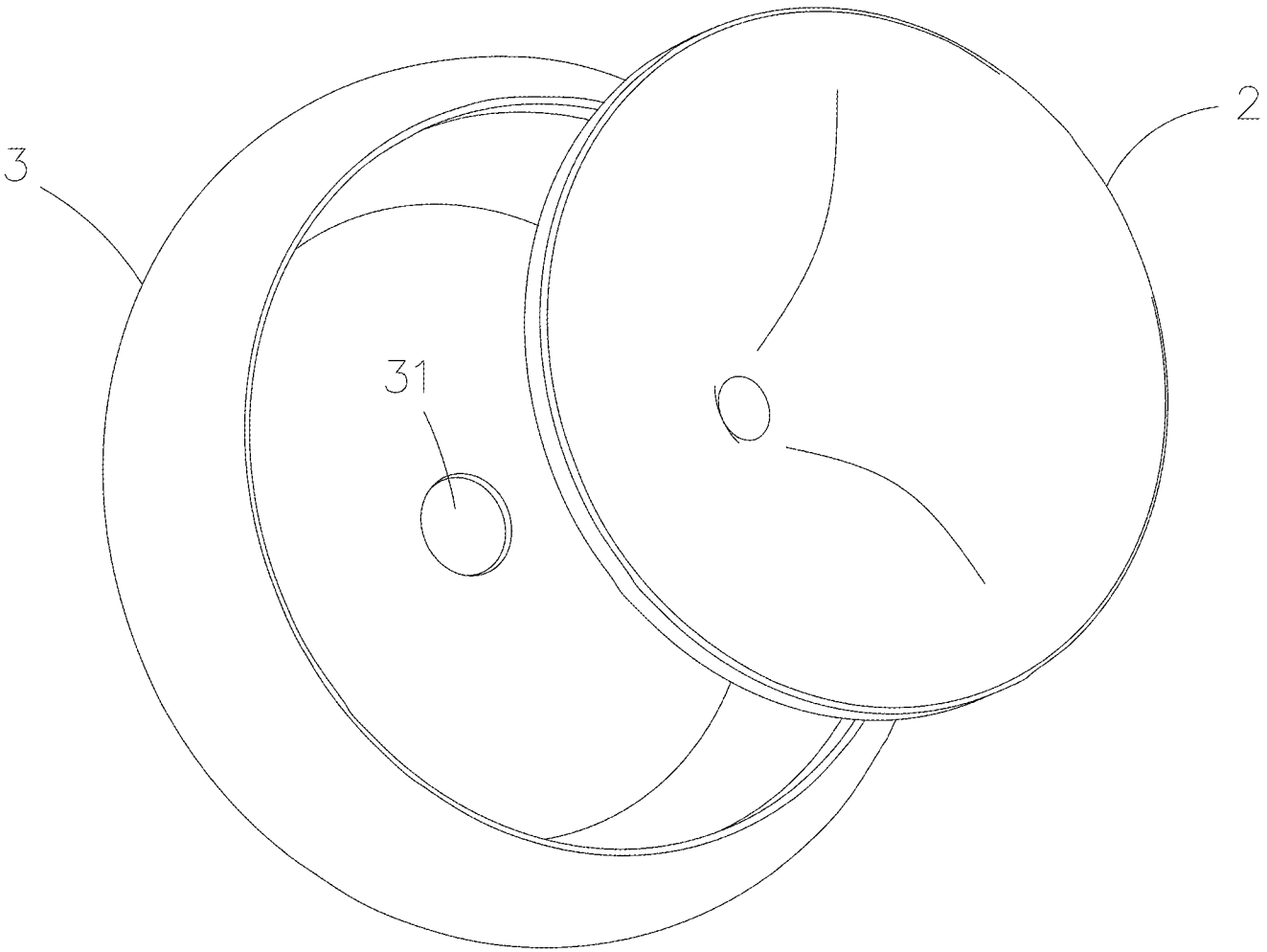
FIG. 4 is an exploded view of elements of the invention.
Figure 5:
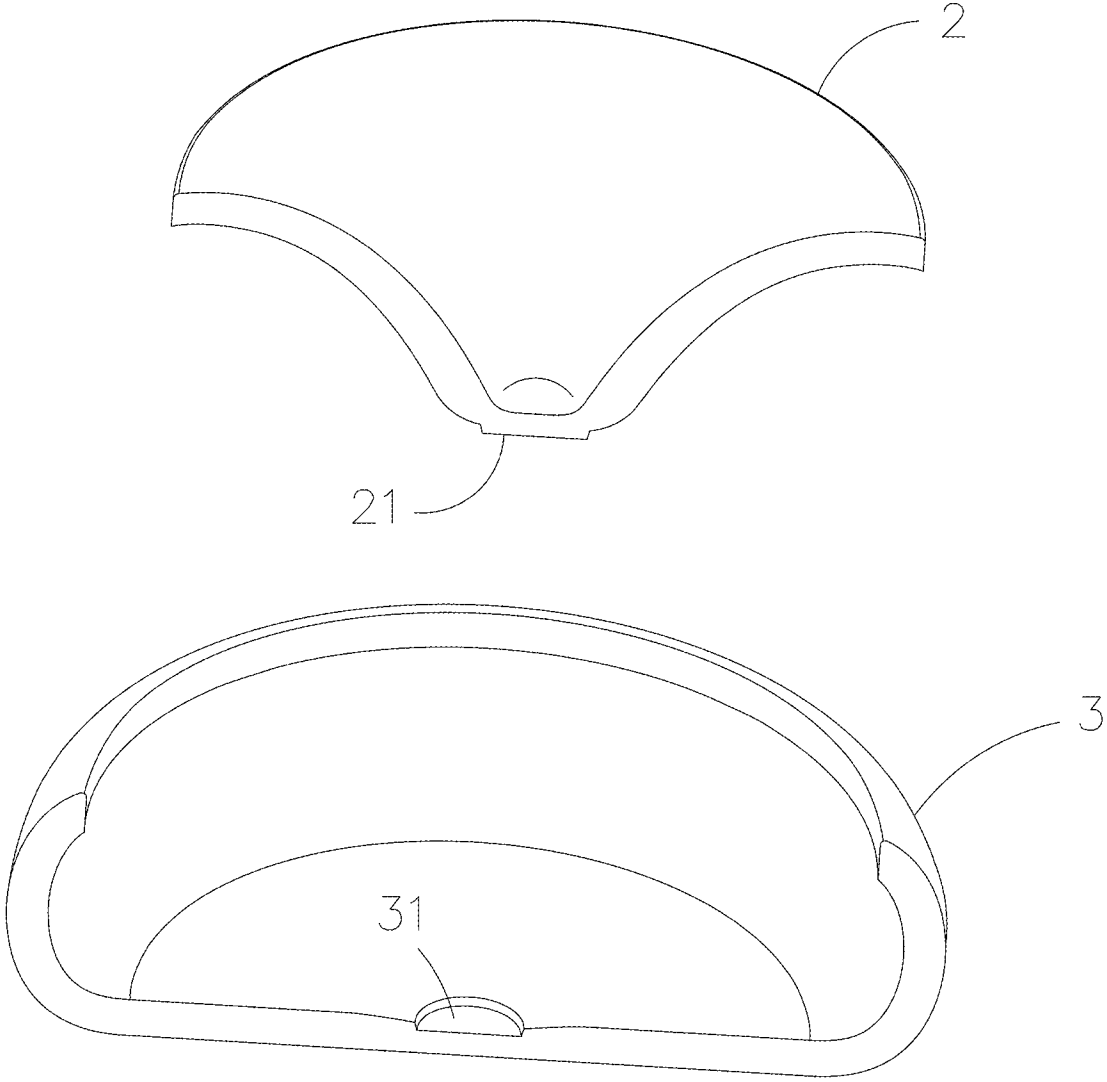
FIG. 5 is an exploded sectional view of elements of the invention.
Figure 6:
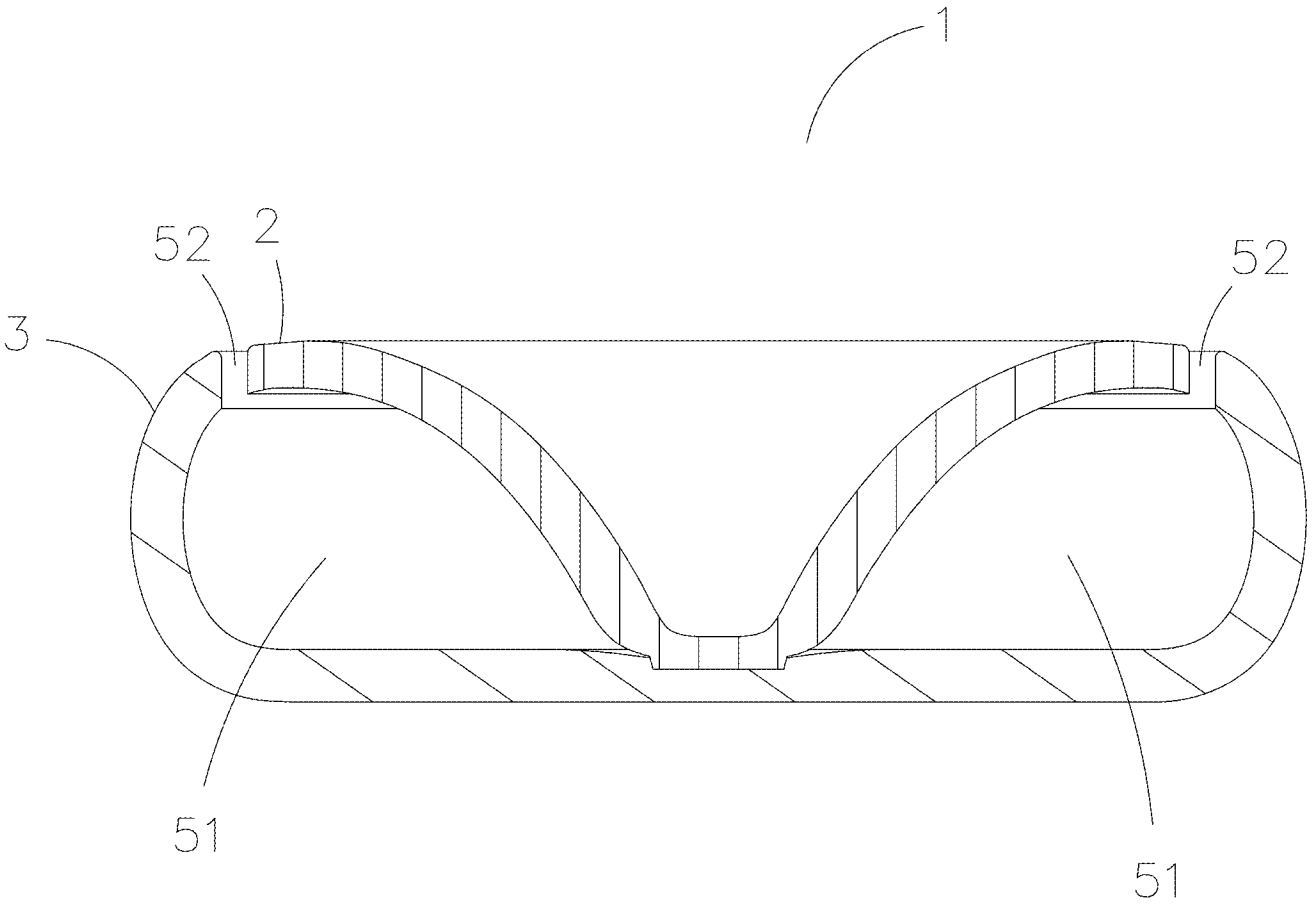
FIG. 6 is a sectional view of the invention.
Figure 7:
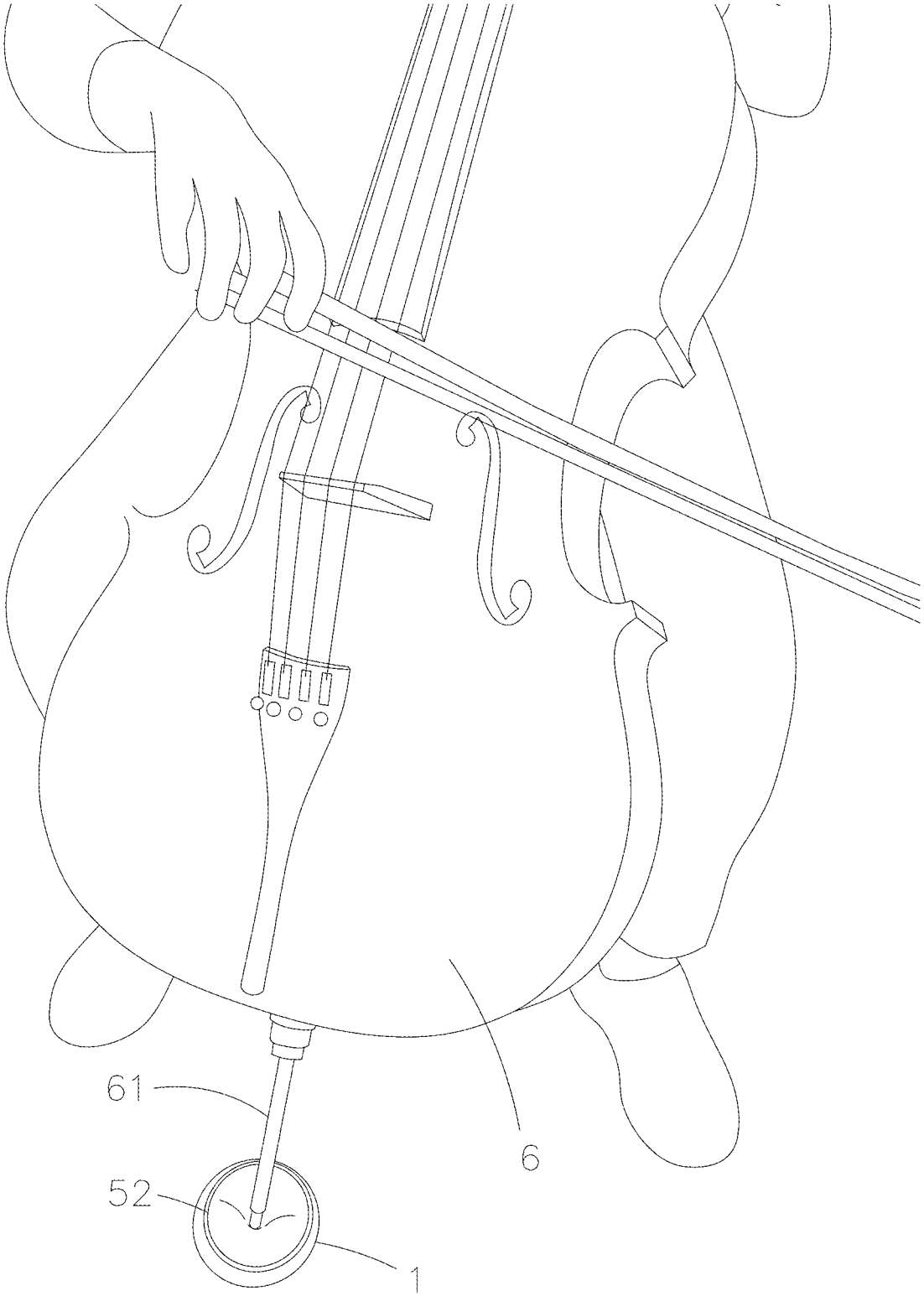
FIG. 7 is a service mode view of the invention.

Referring to FIGS. 1 to 7, a musical instrument sound amplifying device 1 of a first preferred embodiment of the invention comprises a flaring slot 2 and a bowl-like annular base 3. The bottom surface of the flaring slot 2 is provided with a lug 21. The bottom of the bowl-like annular base 3 is provided with a dimple part 31. The lug 21 on the bottom surface of the flaring slot 2 is fixed to the dimple part 31 in the bottom of the bowl-like annular base 3, and a hollow annular chamber 51 is formed inside the musical instrument sound amplifying device 1. Wherein there is an annular sound hole 52 between the opening of the bowl-like annular base 3 and the edge of the flaring slot 2. The inner circumference of the bowl-like annular base 3 is a 3D ring structure of concave surface. The bottom surface of the bowl-like annular base 3 can be provided with an additional slip limiting structure, so as to enhance the slip limiting effect when the musical instrument sound amplifying device 1 is in service mode.

Figure 8:
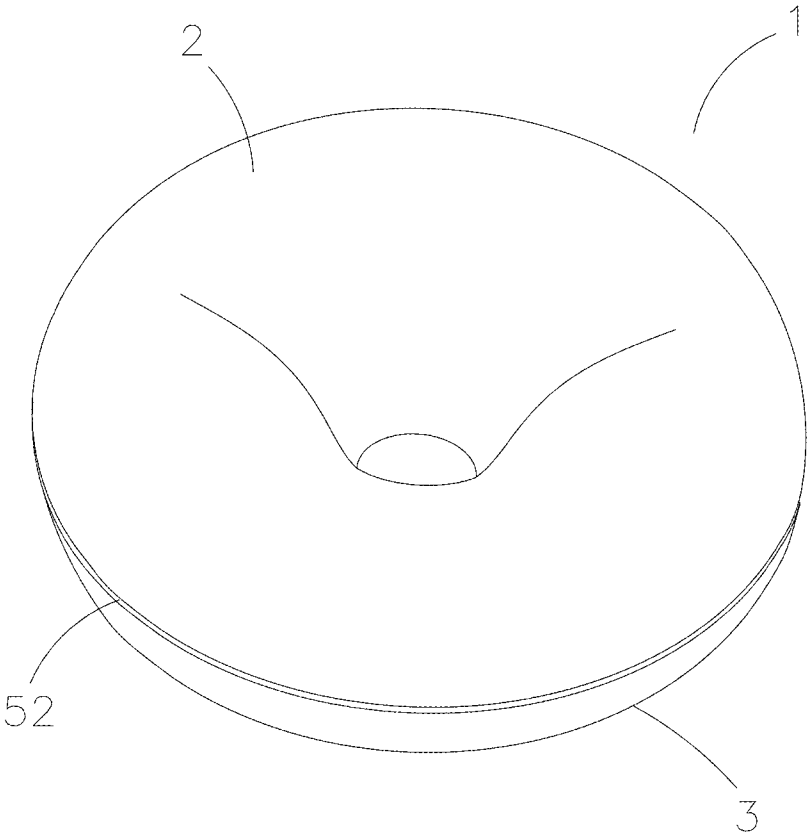
FIG. 8 is a perspective view of a second preferred embodiment of the invention.
Figure 9:
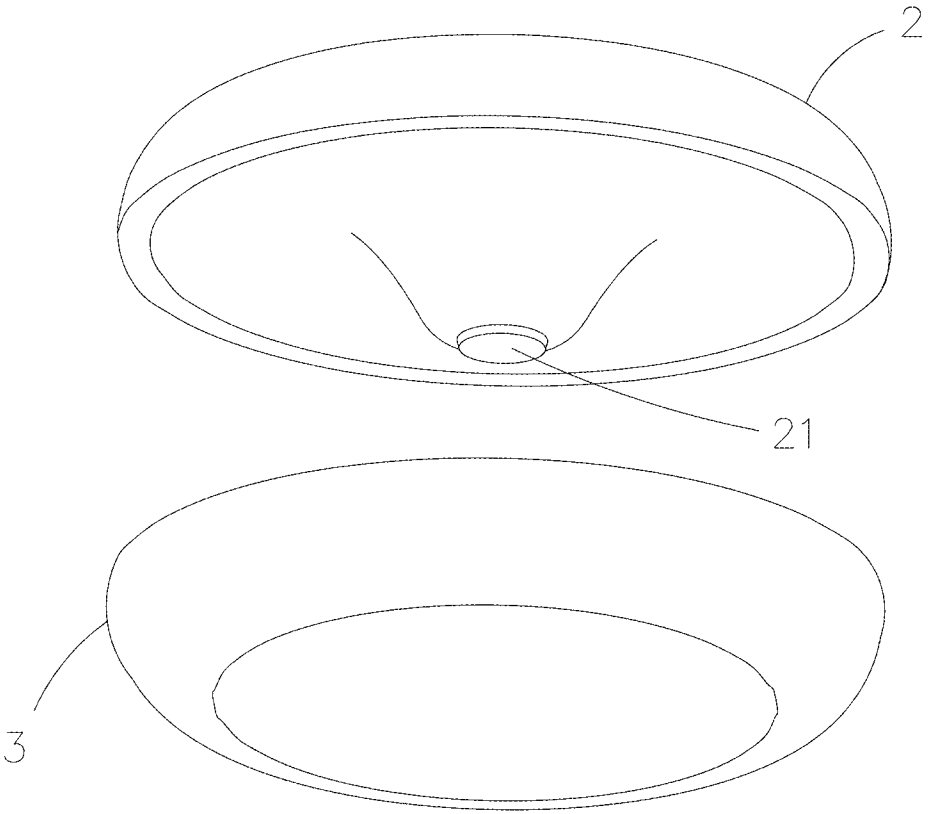
FIG. 9 is an exploded view of elements of the second preferred embodiment of the invention.
Figure 10:
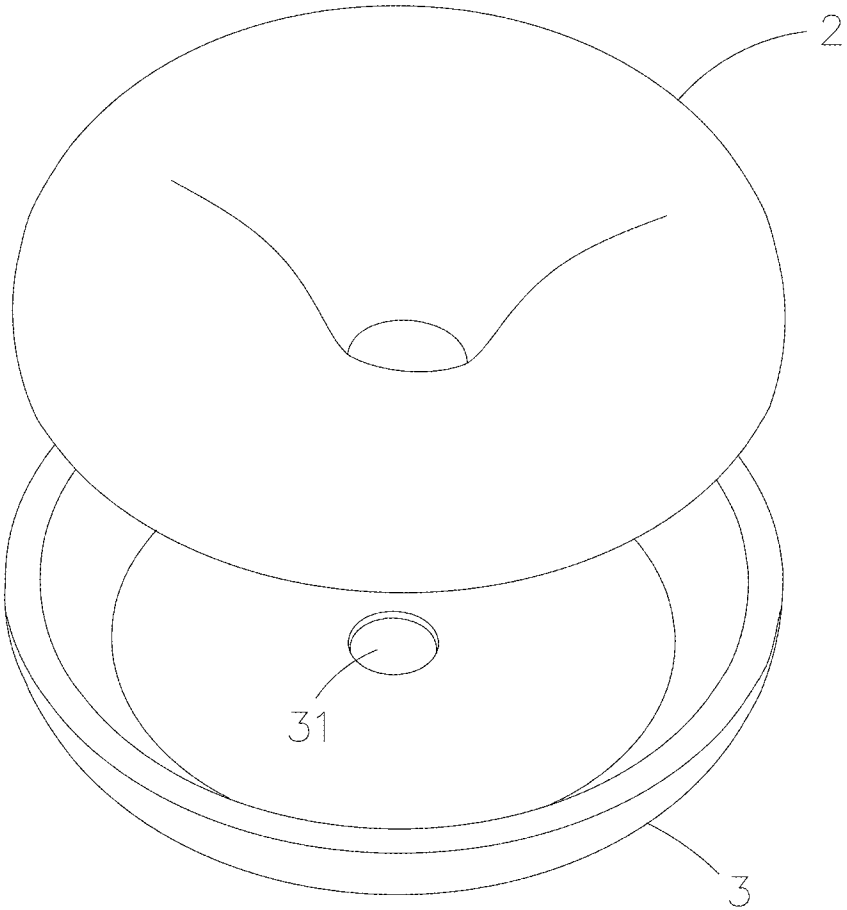
FIG. 10 is an exploded view of elements of the second preferred embodiment of the invention.
Figure 11:
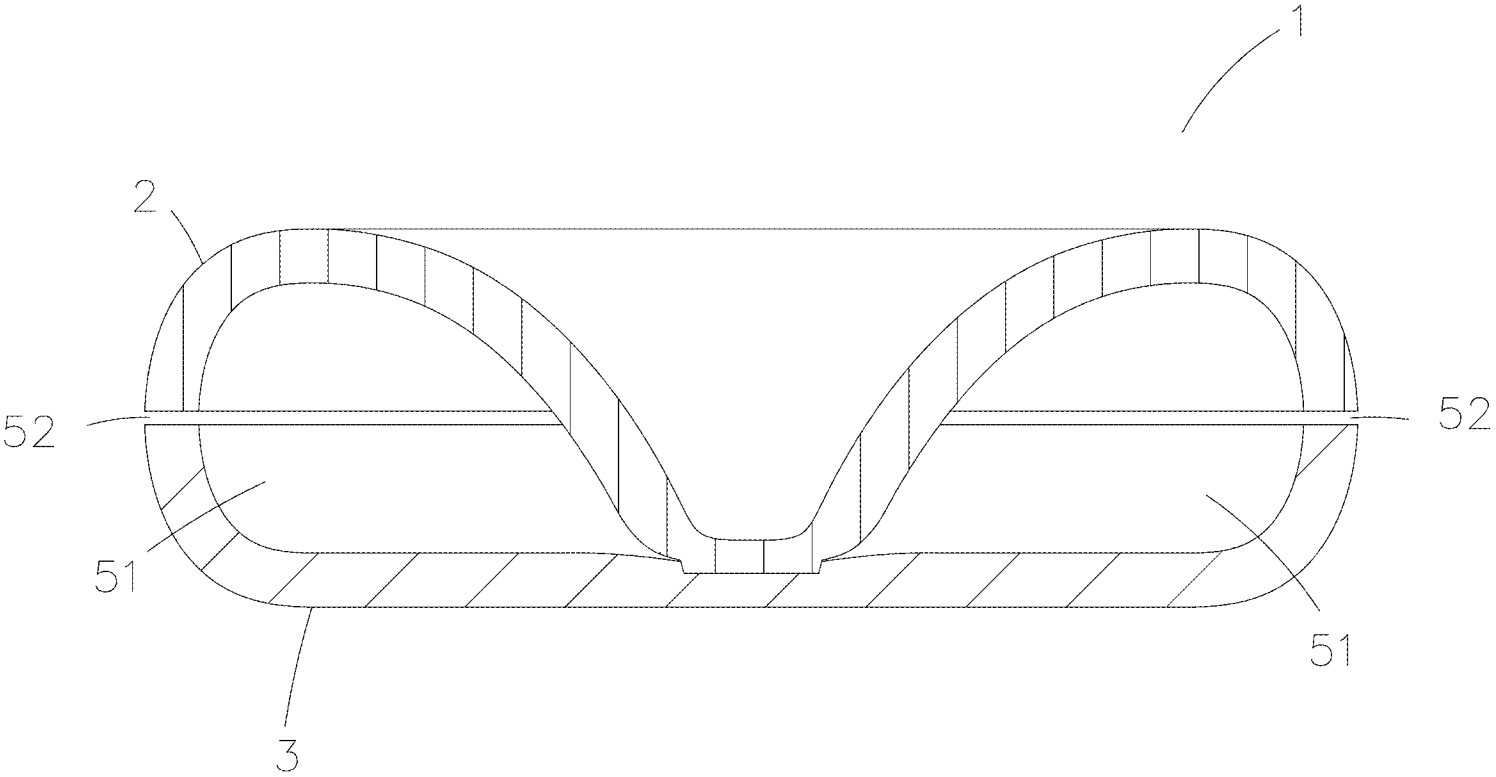
FIG. 11 is a sectional view of the second preferred embodiment of the invention.

Referring to FIGS. 8 to 11, a musical instrument sound amplifying device 1 of a second preferred embodiment of the invention is shown. The characteristics of the second preferred embodiment are substantially the same as that of the first preferred embodiment except the following: the flaring slot 2 and the bowl-like annular base 3 are made of plastics, and they can be made of metal or wood material. The flaring slot 2 and the bowl-like annular base 3 can be made of different materials.

According to such physical characteristics as sound transmission, reflection and diffusion of different media, including plastic, metal and wood materials, appropriate materials can be selected for the tonal quality or acoustic frequency response of different fiddles as the material for producing the flaring slot 2 and the bowl-like annular base 3 of the musical instrument sound amplifying device 1, so as to compensate, enhance or balance the performance of high, medium or low frequency range when playing fiddle by using the musical instrument sound amplifying device 1.

When a performer is to play violoncello, the violoncello 6 is held between thighs and the tail pin 61 under violoncello 6 is inserted in the flaring slot 2 of the musical instrument sound amplifying device 1, so that the violoncello 6 can be placed on the floor firmly and reclined on the performer's body.

When the violoncello 6 is being played, the acoustic vibration conducted from the tail pin 61 to the flaring slot 2 of the musical instrument sound amplifying device 1 generates resonance effect in the hollow annular chamber 51 inside the musical instrument sound amplifying device 1 to generate sound waves identical with fiddle playing frequency, and then the sound waves are reflected by the concave 3D annular surface on the inner circumference of the bowl-like annular base 3 of the musical instrument sound amplifying device 1 to increase the loudness of musical instrument sound greatly, and diffused to the whole performing space through the annular sound hole 52 at 360-degree, so as to form a 3D surround sound field centered on the performer. In comparison to the known plane structure, when the 3D ring structure of concave surface on the inner circumference of the bowl-like annular base 3 reflects the fiddle playing sound waves generated inside the hollow annular chamber 51, there will be a physical effect of concentrated reflection of sound waves, so that the fiddle playing sound waves generated inside can be increased greatly, which are diffused to the performing space instantly to increase the loudness of musical instrument sound.

Therefore, in the course of playing fiddle, the musical instrument sound amplifying device 1 can form the played musical instrument sound into nondirectional 3D surround diffused sound field, so that the audience sitting in any corner of the concert hall or theater can hear graceful melody of high, medium and low frequency ranges manifested by the clear cadent musical instrument sound and the specific changes in tonal levels, apparently remedying the defects of insufficient loudness of musical instrument sound and musical instrument sound diffusion in specific directions of the known sound amplification case (box).

With the 3D surround sound field of the played musical instrument sound provided by the musical instrument sound amplifying device 1, the performer can hear the onsite playing effect more instantly and clearly, so as to effectively master whether the swing and volume are appropriate and whether the melody is correct when playing fiddle, so as to make the corresponding performance or to make immediate correction or modification.

While the invention has been described in terms of preferred embodiments, those skilled in the art will recognize that the invention can be practiced with modifications within the spirit and scope of the appended claims.

What is claimed is:

1. A musical instrument sound amplifying device, comprising:

a hollow annular chamber formed inside the musical instrument sound amplifying device;

a flaring slot including a lug on a bottom; and a bowl-like annular base including a dimple part on a bottom;

wherein the lug is secured to the dimple part;

wherein an annular sound hole is disposed between an opening of the bowl-like annular base and an edge of the flaring slot; and wherein an inner circumference of the bowl-like annular base is a 3D ring structure of concave surface.

2. The musical instrument sound amplifying device defined in claim 1, wherein the bottom of the bowl-like annular base is provided with a slip limiting structure, so as to enhance the slip limiting effect when the musical instrument sound amplifying device is in a service mode.

3. The musical instrument sound amplifying device defined in claim 1, wherein the flaring slot is made of plastic, metal or wood material; and the bowl-like annular base is made of plastic, metal or wood material.

4. The musical instrument sound amplifying device defined in claim 2, wherein the flaring slot is made of plastic, metal or wood material; and the bowl-like annular base is made of plastic, metal or wood material.

* * * * *